US005261129A

United States Patent [19]

Roy

[11] Patent Number: 5,261,129

[45] Date of Patent: Nov. 16, 1993

[54] DUAL VOLUME FLUSHING SYSTEM FOR A FLUSH TANK

[76] Inventor: Benoit L. Roy, 2893, Route 132, St-Ulric, Co., Matane, QC., Canada, G0J 3H0

[21] Appl. No.: 22,305

[22] Filed: Feb. 25, 1993

[30] Foreign Application Priority Data

Feb. 24, 1992 [GB] United Kingdom ..... 9203914

[51] Int. Cl.[5] ..... E03D 1/14

[52] U.S. Cl. ..... 4/326; 4/324; 4/415

[58] Field of Search ..... 4/324, 325, 326, 327, 4/415, 392, 393

[56] References Cited

U.S. PATENT DOCUMENTS 3,795,016 3/1974 Eastman ..... 4/326
4,110,850 9/1978 Tedei ..... 4/326
4,122,564 10/1978 Addicks et al. ..... 4/326
4,353,138 10/1982 Bell ..... 4/326
4,984,312 1/1991 Pickerell et al. ..... 4/415

*Primary Examiner*—Henry J. Recla
*Assistant Examiner*—Charles R. Eloshway
*Attorney, Agent, or Firm*—Ronald L. Morneau

[57] ABSTRACT

A dual volume flushing system for flush tank comprises two flapper valves located adjacent to one another. An abutting tongue is provided between the two valves for preventing the lower valve to interfere with the action of the upper valve. A flush handle is provided to simultaneously actuate both flapper valves in order to allow the water in the flush tank to rush through the valve body in the direction of the toilet bowl to allow the use of a minimal amount of water. The flush handle is also provided with a two system lever to separately actuate the upper flapper valve alone when only liquid material needs to be flushed from the toilet bowl.

5 Claims, 3 Drawing Sheets

DUAL VOLUME FLUSHING SYSTEM FOR A FLUSH TANK

BACKGROUND OF THE INVENTION

1. Field of the Invention

The present invention relates to a combination of two flushing valves for a toilet tank which is adapted to make use of a minimal volume of water when liquid or solid material needs to be flushed out of the toilet bowl. The invention is particularly directed to the simultaneous operation of both valves for an increased acceleration of the flushing water while making use of a restricted volume of water for flushing solid material.

2. Prior Art

A search of the prior art has revealed the following United States patents as making use of two stages for flushing toilet bowls and in particular of two valves located at two different heights in the toilet tank for providing two different levels of water from which water will be alternately flushed:

| | |
|---|---|
| No. 4,504,984 | No. 4,172,299 |
| No. 4,110,850 | No. 3,768,103 |

The patent to Burns U.S. Pat. No. 4,504,984 discloses two valves at two different levels in a flush tank which are operated by a single lever. However, the two valves are operated in sequence which do not allow a simultaneous rushing of the water through both valves. Furthermore, the lower valve is much lower than the upper valve which indicates the need for a larger volume to flow through the lower valve.

In U.S. Pat. No. 4,110,850, Tedei discloses a combination of two flushing valves located at two different levels and operated by two different levers and two different handles. There is no connection shown nor implied between the two handles so as to simultaneously open both valves. Accordingly, Tedei has not contemplated the use of a rushing flow of water passing simultaneously through both valves. In fact, the lower valve is located at a level much lower than the upper valve which explains the reason for expecting the use of a large volume of water to flush solid material.

In U.S. Pat. No. 4,172,299, del Pozo has contemplated a bifurcated activating handle and arm connected by a lever and chain to the first and second valves located at different levels in the toilet tank. Such a device produces consecutive operation of each valve.

The patent to Robinson U.S. Pat. No. 3,768,103 describes a valve assembly which fails to provide a simultaneous operation of both the upper and the lower valves. The difference of height of both valves in the drawings indicates that a much larger volume of water is expected to pass through the lower valve in order to eliminate solid material in the toilet bowl.

The object of the present invention is to restrict the volume of water used for flushing the toilet to a minimal quantity whether it is to flush liquid or solid material. In the case of solid material, the water is accelerated through the vertical flushing pipe by opening both valves simultaneously and this simultaneous opening of the valve is obtained by a single handle operating both valves simultaneously or by a specially designed handle operating either one valve separately and both valves in combination.

Because the lower valve eliminates considerably less liquid than previously known, such second valve is located at a level which is not substantially lower than the first valve eliminating the liquid material. For this purpose, a tongue needs to be installed on the vertical pipe in order to prevent the second valve from interfering with the operation of the first valve and in particular from flipping over beyond the vertical position.

The present flush valve assembly is adaptable to various types of flush tanks by the addition of a coupling for adjusting the height of the valves within the flush tank.

SUMMARY OF THE INVENTION

The present invention is directed to a dual volume flushing system for a flush tank provided with a water outlet opening. The system comprises a valve body made of vertical pipe and a laterally extending pipe. The vertical pipe has an upper open end and a lower open end which is adapted to be connected to the water outlet opening of the flush tank. A first flapper valve is pivotally mounted at the upper end of the vertical pipe for closing the latter projecting sideways from the vertical pipe. The lateral pipe has an aperture at the end opposite the vertical pipe, such aperture being oriented at an angle of about 45° is pivotally mounted for closing the aperture of the lateral pipe. Because both, the upper end of the vertical pipe and the apertures are at not too distant levels, a tongue which is upwardly projecting at the intersection of both pipes is used as a pivoting axle for the second valve and as an abutting surface for preventing the second valve from pivoting beyond a vertical direction so as not to interfere with the first valve. A pivoting handle is adapted to lift both valves simultaneously through a combination of levers and flexible linkage so as to allow the tank to be flushed simultaneously through both pipes when the handle is actuated.

The handle is preferably made of a first handle lever connected to the first valve for exclusively actuating the latter. A second lever which is positioned sideways of the first handle lever is connected to the first handle so that the latter is actuated when the second handle lever is manually actuated.

DETAILED DESCRIPTION OF THE INVENTION

Figure 1:
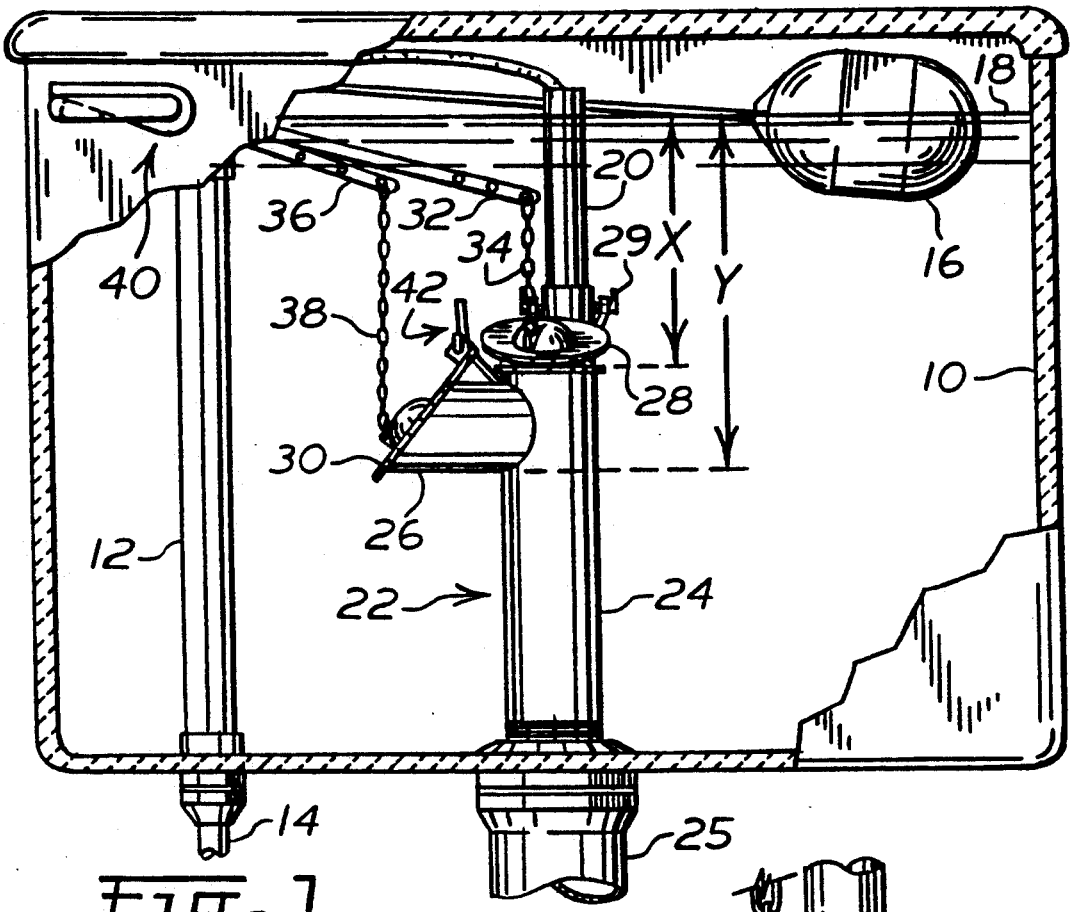
FIG. 1 is a front view of the dual volume flushing system according to the invention shown inside a flush tank.
Figure 2:
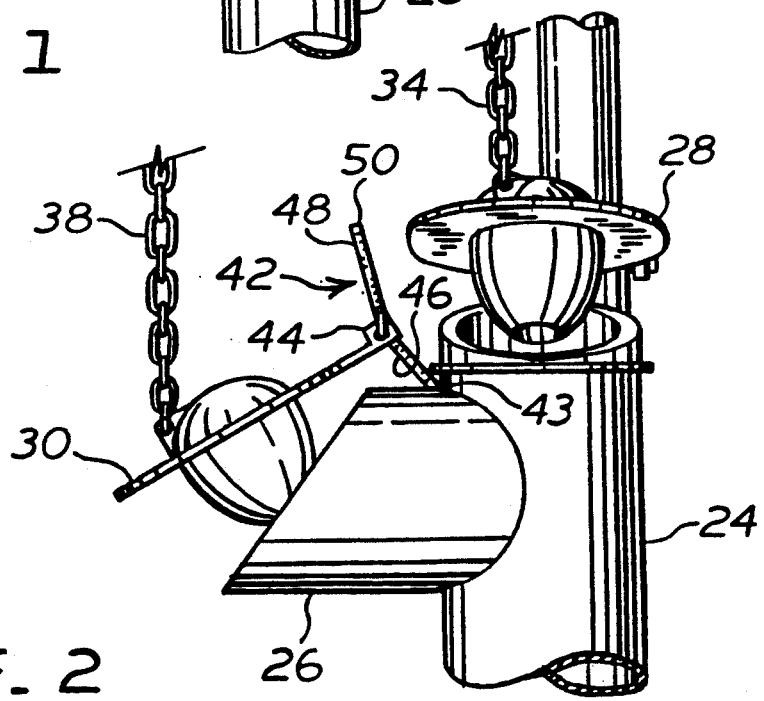
FIG. 2 is an enlarged view of the new flushing system showing two flapper valves in a partially opened position.
Figure 3:
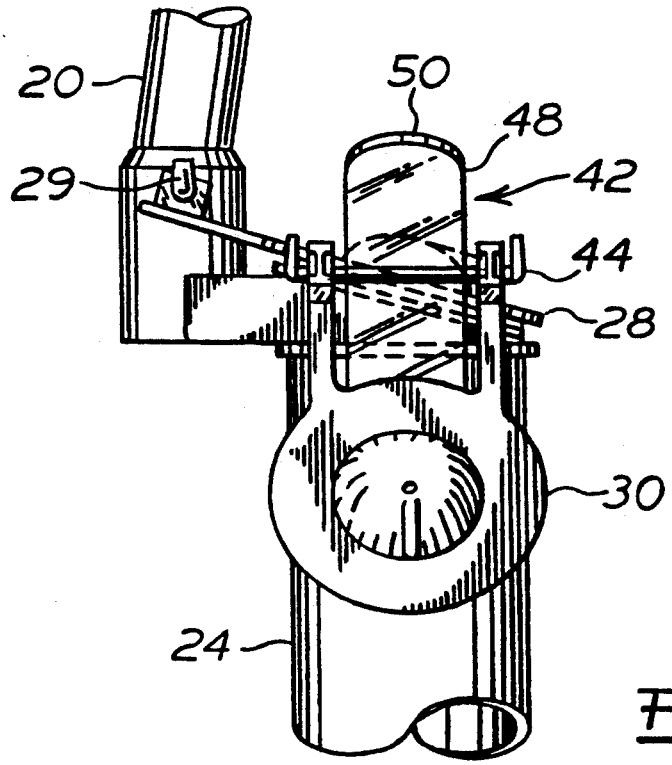
FIG. 3 is a side view of a portion of the flushing system illustrating the pivoting axle of a flapper valve.
Figure 7:
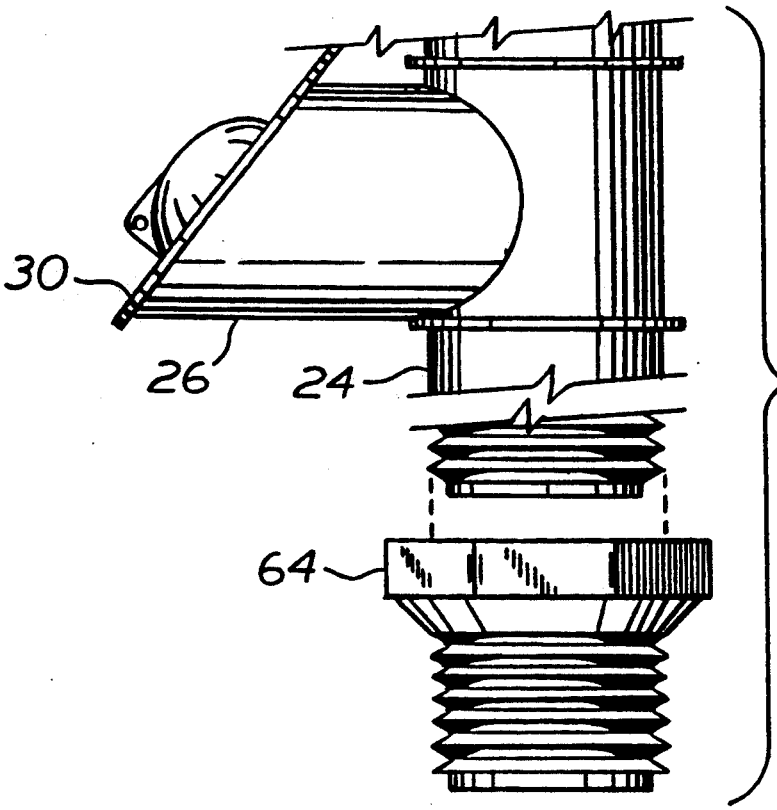
FIG. 7 is a vertical cross-sectional view of a coupling supporting the valve body of the invention.
Figure 4:
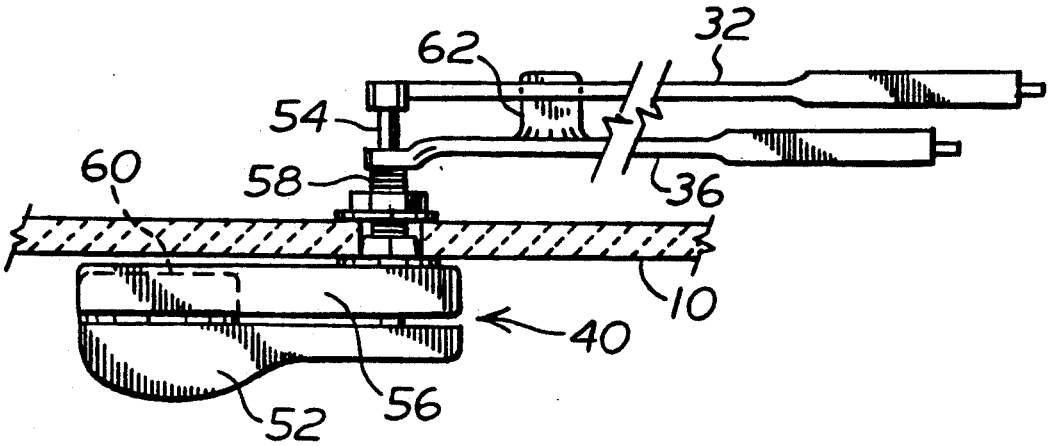
FIG. 4 is a top view of an embodiment of the handle according to the invention.
Figure 5:
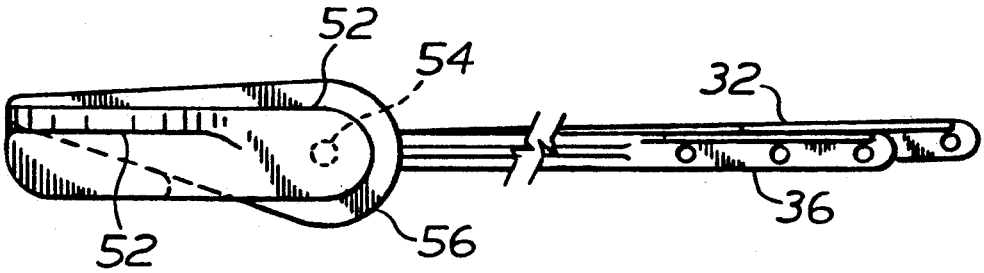
FIG. 5 is a front view of the handle as shown in FIG. 4.
Figure 6:
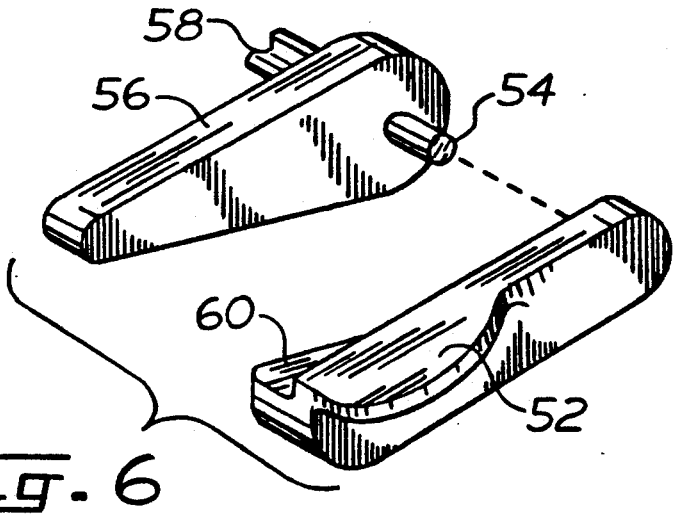
FIG. 6 is a perspective view of the handle shown in FIG. 4.

FIG. 1 gives a general representation of the content of a flush tank 10 of a toilet system. It includes an inflow tube 12 receiving water from an inlet tube 14 in order to fill the flush tank 10 until a float 16 automatically raised by the water in the tank has reached a predetermined level 18. An overflow tube 20 is provided, as a security measure, if the float fails to completely stop the incoming water from the inflow tube 14.

The valve body 22 is constituted of a vertical pipe 24 and a lateral pipe 26 extending sidewise from the vertical pipe 24. The upper end of the vertical pipe 24 is closed by a first conventional flapper valve 28. The end of the lateral pipe 26 is closed by a second similar flapper valve 30. The first flapper valve 28 is set at a small angle of about 5 to 10 degrees relative to the axis of the vertical pipe while the second flapper valve is set at an angle between 30 and 60 degrees relative to the vertical axis of the vertical pipe 24.

The flapper valve 28 is pivotally mounted on axle 29 fixed on the overflow tube 20 and is adapted to be raised by a flush lever 22 and a flexible link such as a chain 34. The second flapper valve 30 can be separately raised by a flush lever 36 and a flexible link or chain 38. Both flush levers 32 and 36 are actuated by a flush control arm or handle 40 which can provide a single action of flush lever 32 and a simultaneous combined action for the flush levers 32 and 36. One of the important characteristics of the present invention relates to the level of the first and second flapper valve which are located in the flush tank 10. The majority of the flush tanks, such as 10, have a capacity of 16 or 11 liters. It has been found that a minimum of 5 liters is needed to flush a standard toilet bowl and accordingly, the first flapper valve 28 must be located at a predetermined elevation X from the maximum level of the water 18 in the tank 10. The flapper valve 28 is used when only liquid such as urine has been poured into the toilet bowl. The operation of the control arm 40, which will be fully explained later, is adapted to lift the flush lever 32 independently of the flush lever 36. Through this operation, 5 liters of water will flow through the valve body 22. It should be noticed that in a 16 liter tank, only about $\frac{1}{3}$ of the water is used and for this reason, the level of the flapper valve 28 is at a level of about $\frac{2}{3}$ the height of the maximum water level 18.

In prior patents referred to previously, the second flapper valve 30 is located at a much lower level relative to the first flapper valve 28 because a considerable amount of water needs to be flushed for eliminating solid material which are in a toilet bowl. In the present invention, the second flapper valve 30 is located at a level which is relatively close to the level of the first flapper valve 28 because it is intended to be at a level Y which represents 8 liters from the top level 18 of the water in the tank 10. However, such a capacity of water is not sufficient by itself to flush the solid material in the toilet bowl. However, it has been found that by the simultaneous opening of the two flapper valves 28 and 30 being located respectively at levels X and Y, the gravitational power produces an acceleration of the water which is sufficient to eliminate the solid material in the toilet bowl. This phenomenon is obtained by the simultaneous opening of both flapper valves. Under these conditions, a minimum of water of 8 liters is sufficient to flush the solid material out of the toilet bowl receiving the water from the valve body 22 and the outlet tube 25.

Because the lateral pipe 26 is located at a level adjacent the first flapper valve 28, a problem occurs, due to the interference of the first and second flapper valves 28 and 30 when the second flapper valve 30 is raised beyond a vertical direction. For this reason, an upwardly projecting tongue 42 is installed at the intersection 43 of the lateral pipe 26 and the vertical pipe 24 so as to provide a pivotal axle 44 for the flapper valve 30. The axle 44 is remote from the first flapper valve 28. The suitable location of the axle 44 is obtained by the tongue 42 having a portion 46 abutting at the intersection 43 of the pipe 26 and 24 and substantially bisecting the angle between the two pipes for moving away the axle 44 from the flapper valve 28 and by a portion 48 extending substantially vertically from the axle 44 up to a height 50 sufficient to stop the flapper valve 30 and prevent it from flipping over in the direction of the flapper valve 28 when it is raised in a vertical direction by the chain 38. The axle 44 is a ridge formed at the intersection of portions 46 and 48. Such a tongue 42 is not required when the lateral pipe 26 is located at a lower level of the valve body 22 such as in the prior art, because the flapper valve 30 is prevented from flipping over by the vertical pipe 24 itself.

In order to properly operate the flapper valve 28 and 30, the handle 40 is constructed so as to raise the flush lever 32 separately and to raise both flush levers 32 and 36 simultaneously and in combination for the purpose previously explained. The flush control arm 40 includes a handle 52 which actuates the flush lever 32 substantially in a conventional manner through the axle 54. A second handle 56 adjacent and parallel to the handle 52 is mounted on a sleeve 58 coaxially mounted on the axle 54 in order to actuate the flush lever 36 which extends from the sleeve 58. In order to obtain the simultaneous action of both flush levers 32 and 36, a transversal arm 60 is secured to the first handle 52 below the latter and extending below the second handle 56. Accordingly, when the second handle 56 is pivoted downwardly, it simultaneously actuates the first handle 52 and accordingly both flush levers 32 and 36 and both flapper valves 28 and 30 are simultaneously actuated to provide a simultaneous flow of water through both the lateral and the vertical pipes 26 and 24. It should be understood that a transversal arm 62 may be substituted for the transversal arm 60 to obtain similar sychronization of both levers 32 and 36. In this condition, instead of the transversal arm 60, the transversal arm 62 is secured to and under the flush lever 36 and extends under the flush lever 32. Accordingly, when the handle 56 is actuated, the flush lever 36 is raised and forces the flush lever 32 to raise simultaneously on account of the transversal arm 62 extending under the flush lever 32.

It is pointed out that a patentable novelty resides in the fact that both flapper valves 28 and 30 are simultaneously opened to obtain an accelerated flow of water to produce a greater flushing effect with a minimal amount of water. Such a combined action is novel and is obtained by the actuation of a single handle irrespective of this handle being able to actuate separately only one of the two flush levers.

Considering that the new flushing system may be adaptable to a plurality of flush tanks having different water capacities, the vertical pipe is contemplated to be combined with an extension coupling 64 adapted to be mounted on the vertical coupling 24 for suitably adjusting the level of the flapper valves 28 and 30 at the desired level X and Y.

Two of the most conventional flush tanks 10 have a capacity of 16 and 11 liters. The vertical pipe 24 is adapted to have a suitable length for the flush tank having a capacity of 11 liters. The extension coupling 64 is added and suitably adjusted when the flushing system according to the invention is used for a flush rank having a capacity of 16 liters.

The use of a minimal amount of water which is contemplated in the present invention is essentially directed for environmental purposes. However, for each liter which is saved, the aqueduct and all the pumping mechanisms have to work that much less. Such a saving of water is also particularly useful for people making use of a well which drains more slowly.

I claim:

1. A dual volume flushing system for a flush tank provided with a water outlet opening, said system comprising a valve body including a vertical pipe having an upper open end and a lower open end, said lower end adapted to be connected to said water outlet opening, a first flapper valve pivotally mounted at the upper open end of said vertical pipe for closing the latter, a lateral pipe sidewardly projecting from said vertical pipe for forming an intersection at a level adjacent said upper end of the vertical pipe, said lateral pipe having one end opposite the vertical pipe defining an aperture disposed at an angle of about 30 degrees to 60 degrees relative to the vertical pipe, a second flapper valve for closing said aperture, an upwardly projecting tongue located at the intersection of said pipes, said second valve being pivotally mounted on said tongue, a first flush lever and a first flexible linkage connected to said first valve, a second flush lever and a second flexible linkage connected to said second valve, a pivoting handle adapted to be mounted on said flush tank, said handle connected to both of said levers and including means for selectively actuating said first valve or the combined first and second valves for selectively opening the upper end of said vertical pipe for a first volume flush or simultaneously opening the upper end of the vertical pipe and the aperture of said lateral pipe for a second volume flush.

2. A system as recited in claim 1, wherein said tongue has an angular shape which forms a ridge away from the intersection of the lateral and the vertical pipes, said second valve being pivotally mounted along said ridge, said tongue having an upper part for preventing said second valve from pivoting beyond a vertical plane.

3. A system as recited in claim 1, wherein said means comprises a first handle lever connected to said first flush lever for exclusively opening said first valve, and a second handle lever positioned sideways of said first handle lever and a transversal arm fixed to said first handle lever for simultaneously actuating said first handle lever and both of said valves when the second handle lever is actuated.

4. A system as recited in claim 1, wherein said vertical pipe has a length for defining a predetermined height adapted to provide a flushing capacity of about 5 liters, and wherein said second valve is located at a height adapted to provide a flushing capacity of about 8 liters, whereby actuation of the second handle lever provides a combined and simultaneous flushing through both valves while limiting the flushing capacity to 8 liters.

5. A system as recited in claim 4, wherein said vertical pipe comprises an extension coupling for adjusting said predetermined height.

* * * * *